US007620358B2

(12) United States Patent
Kadowaki et al.

(10) Patent No.: US 7,620,358 B2
(45) Date of Patent: Nov. 17, 2009

(54) DEVELOPER COLLECTING APPARATUS HAVING TILTABLE WASTE DEVELOPER CONTAINER

(75) Inventors: Hideaki Kadowaki, Kyoto (JP); Susumu Murakami, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 589 days.

(21) Appl. No.: 11/472,424

(22) Filed: Jun. 22, 2006

(65) Prior Publication Data

US 2007/0009295 A1 Jan. 11, 2007

(30) Foreign Application Priority Data

Jun. 22, 2005 (JP) ..... P2005-182314

(51) Int. Cl.
*G03G 21/00* (2006.01)

(52) U.S. Cl. ..... 399/358; 399/360

(58) Field of Classification Search ..... 399/358, 399/360

See application file for complete search history.

(56) References Cited

U.S. PATENT DOCUMENTS 5,617,195 A * 4/1997 Torimaru et al. ..... 399/358

FOREIGN PATENT DOCUMENTS

| | | |
|---|---|---|
| JP | 6-10556 | 1/1994 |
| JP | 2000-352852 | 12/2000 |
| JP | 2003-345203 | 12/2003 |
| JP | 2004-145290 A | 5/2004 |

* cited by examiner

*Primary Examiner*—David M Gray
*Assistant Examiner*—Ruth N Labombard
(74) *Attorney, Agent, or Firm*—Nixon & Vanderhye, PC

(57) ABSTRACT

A developer collecting apparatus includes a positioning frame for determining a mounting position of a photoreceptor onto a casing; a waste developer container in which waste developer eliminated by cleaning section is stored; and a container mounting section for mounting the waste developer container so as to be removable from the positioning frame and holding the waste developer container so as to be angularly displaceable with respect to the positioning frame. Further, the container mounting section includes a container holding member that is disposed so as to be angularly displaceable with respect to the positioning frame, for holding the waste developer container; a cam member disposed so as to be movable in a direction orthogonal to a direction in which the container holding member is angularly displaced; and an elastic member for biasing the cam member to the container holding member with an elastic force.

14 Claims, 13 Drawing Sheets

DEVELOPER COLLECTING APPARATUS HAVING TILTABLE WASTE DEVELOPER CONTAINER

This application claims priority to Japanese Application No. 2005-182314 filed Jun. 22, 2005; the entire contents of which are hereby incorporated by reference.

BACKGROUND OF THE TECHNOLOGY

1. Field of the Technology

The present technology relates to a developer collecting apparatus installed in an image forming apparatus such as an electrophotographic image forming apparatus.

2. Description of the Related Art

In recent years, a shift from monochrome image forming apparatuses to full-color image forming apparatuses has become common and, as the development of image forming apparatuses has advanced, color image forming apparatuses have come to be widely used. For electrophotographic image forming apparatuses of color image forming apparatuses, in order to respond to reduction in size of the apparatuses and increase in speed of color image formation, an indirect transfer method of using an intermediate transfer body has been much proposed. In this method, image data separated by color component are stacked from electrostatic latent image carriers (may be referred to as photoreceptors hereafter) of a plurality of image forming units (may be referred to as process printing units) onto the intermediate transfer body to form developer images (primary transfer), and the developer images transferred in the primary transfer are transferred together onto a conveyed recording sheet that is a transfer-subjected medium (secondary transfer) to form a color image on the recording sheet.

In common, it is well known that in a transfer process in image formation, at the time of the primary transfer from the photo receptors to the intermediate transfer body, 100% of developer that forms the developer images on the photoreceptors is not transferred to the intermediate transfer body, but the developer remains a little on the photoreceptors. The transfer efficiency is considered approximately 90% in general. Also in the secondary transfer process of transferring the developer images formed on the intermediate transfer body onto the recording sheet, residual developer is produced in the same manner as described above.

Accordingly, in normal, an image forming apparatus is provide with a cleaning apparatus for collecting the residual developer remaining on the photoreceptors and the intermediate transfer body in the primary and secondary transfer processes, and a developer collecting container for collecting the residual developer eliminated as waste developer by the cleaning apparatus (for example, refer to Japanese Unexamined Patent Publication JP-A 2000-352852). However, in the case of installing a plurality of developer collecting containers for a plurality of image forming units and an intermediate transfer body, a tie-in space in the apparatus needs to be large, which is undesirable in that compact design is hard, user operability decreases and the waste developer contaminates the inside of the apparatus.

Considering the above points, the applicant already proposed, in Japanese Patent Application No. 2004-335499, an integrated developer collecting container that stores waste developer produced from a plurality of production sources of the residual developer to seek solution of the above problems.

However, the above proposal discloses a technique for realizing integration of the containers and solving the problems on compact design and so on, but does not disclose how to realize movement and hold of the waste developer collecting container into at least three operating positions in which the container should be positioned when the container is installed in an image forming apparatus. The three operating positions are: a position in which the container is installed in the image forming apparatus and the apparatus is in operation; a removal position for replacing the waste developer container; and a position to carry out maintenance of the image forming apparatus.

SUMMARY OF THE TECHNOLOGY

An object of the technology is to provide a developer collecting apparatus in which a waste developer container can be removed easily and can be positioned and fixed simply and easily.

The technology provides a developer collecting apparatus installed in an image forming apparatus having an image carrier on which an electrostatic latent image is formed by exposure with light corresponding to image data; an intermediate transfer body to which a developer image obtained by developing the electrostatic latent image on the image carrier is transferred; a cleaning section for eliminating residual developer that remains on the image carrier without being transferred from the image carrier to the intermediate transfer body and residual developer that remains on the intermediate transfer body without being transferred from the intermediate transfer body to a transfer-subjected medium; and a casing for accommodating the image carrier, the intermediate transfer body and the cleaning section therein, the developer collecting apparatus collecting the developer eliminated from the image carrier and the intermediate transfer body by the cleaning section, the developer collecting apparatus comprising:

a positioning frame for determining a mounting position of the image carrier onto the casing;

a waste developer container in which waste developer eliminated by the cleaning section is stored; and a container mounting section for mounting the waste developer container so as to be removable from the positioning frame and holding the waste developer container so as to be angularly displaceable with respect to the positioning frame.

The waste developer container of the developer collecting apparatus is mounted by the container mounting section so as to be removable from the positioning frame and is held so as to be angularly displaceable. Consequently, it becomes easy to remove as well as move and hold the waste developer container into a desired position in which the waste developer container should be positioned when installed in the image forming apparatus.

Further, it is preferable that the container mounting section includes:

a container holding member disposed so as to be angularly displaceable with respect to the positioning frame, for holding the waste developer container;

a cam member disposed so as to be movable in a direction orthogonal to a direction in which the container holding member is angularly displaced; and an elastic member for biasing the cam member to the container holding member with an elastic force.

The container mounting section includes the container holding member disposed so as to be angularly displaceable with respect to the positioning frame, for holding the waste developer container, the cam member disposed so as to be movable in a direction orthogonal to a direction in which the container holding member is angularly displaced, and the elastic member that biases the cam member to the container holding member with an elastic force. Thus, the container holding member is disposed so as to be angularly displaceable with respect to the positioning frame, so that the waste developer container held by the container holding member can be angularly displaced. The cam member, which is disposed so as to be movable in a direction orthogonal to an angular displacement direction of the container holding member, is biased to the container holding member by a biasing force of the elastic member, so that it becomes possible to position and fix the waste developer container via the container holding member.

Furthermore, it is preferable that an engagement projection is formed on the waste developer container;

an engagement depression is formed on the container holding member of the container mounting section; and the waste developer container is held by the container holding member so as to be removable, by engagement of the engagement projection with the engagement depression of the container holding member.

The waste developer container is held by the container holding member so as to be removable, by engagement of the engagement projection formed on the waste developer container with the engagement depression formed on the container holding member of the container mounting section. Consequently, it becomes possible to easily remove the waste developer container from the container holding member.

Still further, it is preferable that the elastic member is placed between the positioning frame and the cam member, and biases the cam member to the container holding member with an elastic force.

The elastic member is placed between the positioning frame and the cam member, and biases the cam member to the container holding member with an elastic force. By thus placing the elastic member, it is possible to make the elastic force act sufficiently on the waste developer container via the cam member and the container holding member, so that it becomes possible to hold and fix the waste developer container with a simple configuration.

Still further, it is preferable that the container holding member is angularly displaced by sliding on the cam member;

a position to which the cam member moves varies depending on an angular displacement position of the container holding member with respect to the positioning frame; and a biasing force of the elastic member that biases the cam member to the container holding member varies depending on the position to which the cam member moves.

The container holding member is angularly displaced by sliding on the cam member, a position to which the cam member moves varies depending on an angular displacement position of the container holding member with respect to the positioning frame, and a biasing force of the elastic member that biases the cam member to the container holding member varies depending on the position to which the cam member moves. Accordingly, it is possible to easily remove the waste developer container by setting a position in which the biasing force is weak as a position for removing, and set a position in which the biasing force is strong as a position for holding and fixing the waste developer container.

Still further, it is preferable that at least three positions including first, second and third positions are determined as an angular displacement position of the container holding member with respect to the positioning frame;

a biasing force of the elastic member in the second position is smaller than a biasing force of the elastic member in the first and third positions;

the waste developer container is held so as to close an opening portion of the image forming apparatus in which the waste developer container is to be provided, in a state where the container holding member is in the first position;

the waste developer container is removed from the container holding member in a state where the container holding member is in the second position; and the waste developer container is held so as to open the opening portion of the image forming apparatus in which the waste developer container is to be provided, in a state where the container holding member is in the third position.

At least three positions including first to third positions are determined as an angular displacement position of the container holding member with respect to the positioning frame, and a biasing force of the elastic member in the second position is set so as to be smaller than a biasing force of the elastic member in the first and third positions. When the developer collecting apparatus is installed in the image forming apparatus, the waste developer container is held in a state where the container holding member is in the first position so as to close the opening portion of the image forming apparatus in which the waste developer container is to be provided, the waste developer container is removed from the container holding member in a state where the container holding member is in the second position, and the waste developer container is held in a state where the container holding member is in the third position so as to open the opening portion of the image forming apparatus in which the waste developer container is to be provided. Consequently, the waste developer container is removed from the container holding member and replaced with ease in the second position in which the biasing force is small, and the waste developer container is securely held and fixed by the container holding member in the first and third positions in which the biasing force is large.

BRIEF DESCRIPTION OF THE DRAWINGS

Other and further objects, features, and advantages will be more explicit from the following detailed description taken with reference to the drawings wherein.

DETAILED DESCRIPTION

Figure 1:
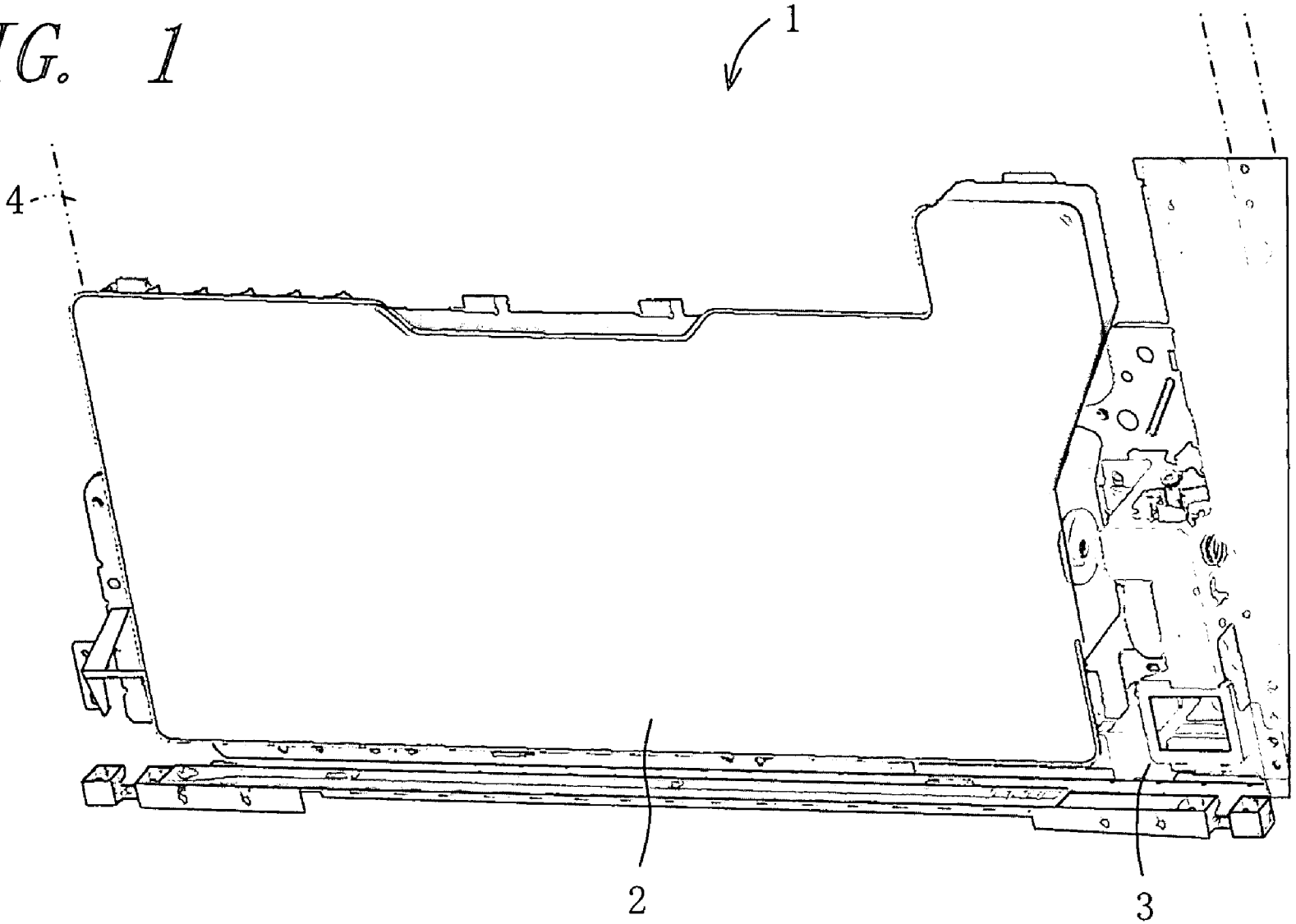
FIG. 1 is a perspective view illustrating the outline of a developer collecting apparatus.

Now referring to the drawings, preferred embodiments of the technology are described below.

Figure 2:
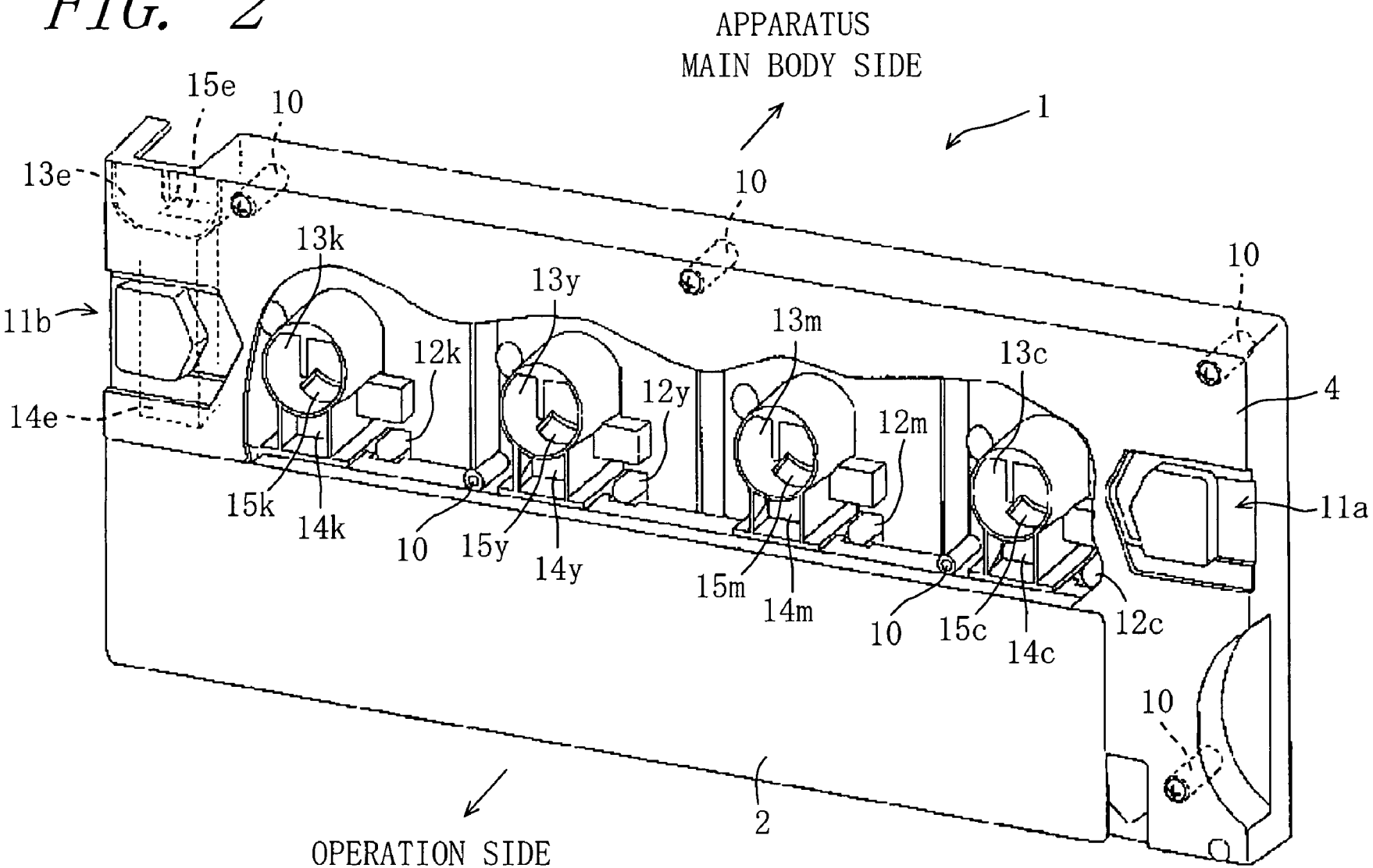
FIG. 2 is a simplified view illustrating the configuration of a positioning frame disposed to the developer collecting apparatus.
Figure 3:
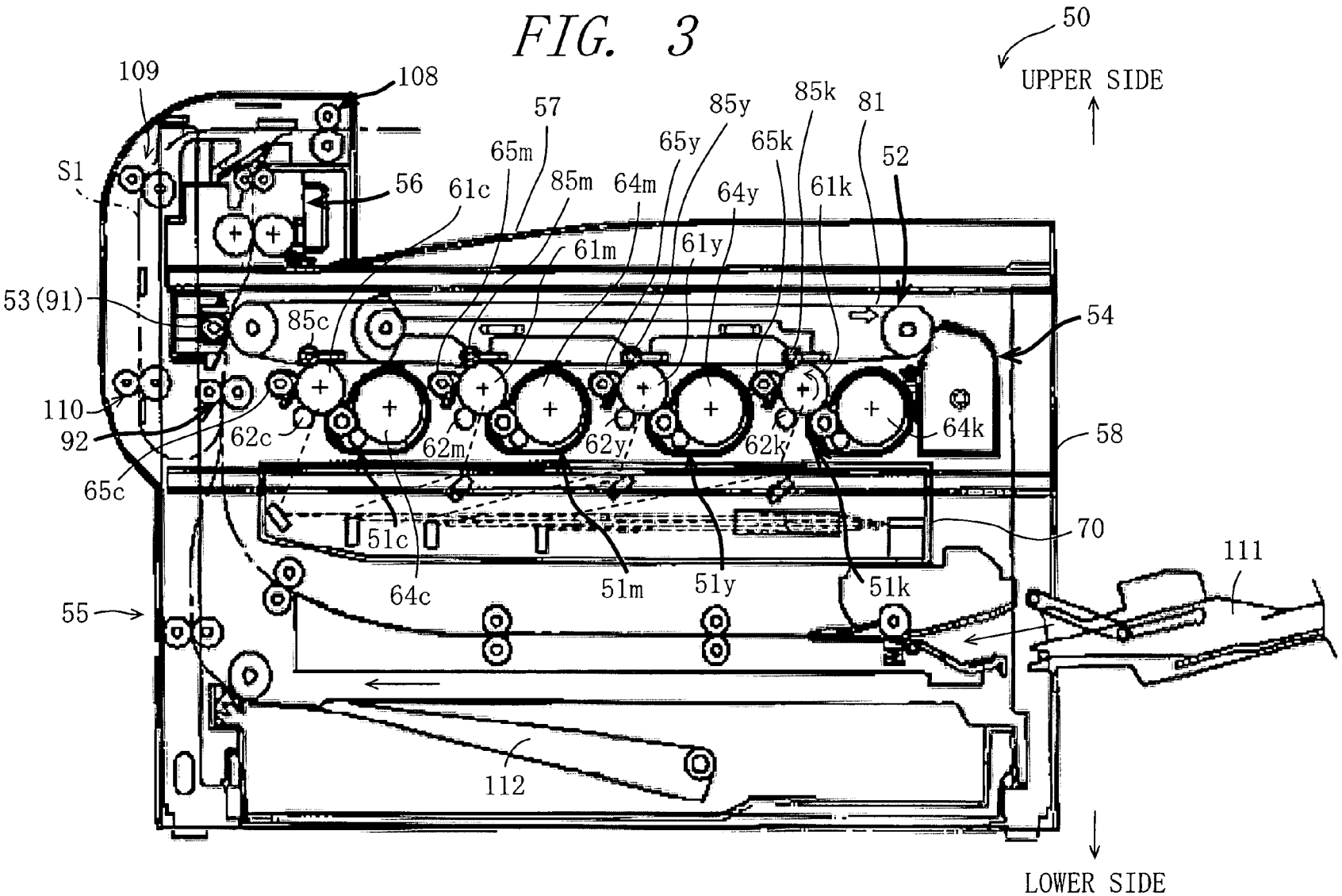
FIG. 3 is a view exemplifying the configuration of an image forming apparatus in which the developer collecting apparatus is installed.

FIG. 1 is a perspective view illustrating the outline of a developer collecting apparatus 1. FIG. 2 is a simplified view illustrating the configuration of a positioning frame 4 disposed to the developer collecting apparatus 1. FIG. 3 is a view exemplifying the configuration of an image forming apparatus 50 in which the developer collecting apparatus 1 is installed.

The developer collecting apparatus 1 is installed in the image forming apparatus 50 as illustrated in FIG. 3, for example. The image forming apparatus 50 comprises an image forming unit 51, an intermediate transfer body 52, a transfer section 53, cleaning sections 65 and 54, and a casing 58. The image forming unit 51 is provided with an image carrier 61 (referred to as photoreceptor hereafter) and a developing section 64. On the photoreceptor 61, an electrostatic latent image is formed by exposure with light corresponding to image data. The developing section 64 develops the electrostatic latent image formed on the photoreceptor 61 to form a developer image. The developer image formed on the photoreceptor 61 is transferred to intermediate transfer body 52; The transfer section 53 transfers the developer images transferred to the intermediate transfer body 52 together to a recording sheet that is a transfer medium. The cleaning sections 65 and 54 eliminate residual developer that remains on the photoreceptor 61 without being transferred from the photoreceptor 61 to the intermediate transfer body 52 and residual developer that remains on the intermediate transfer body 52 without being transferred from the intermediate transfer body 52 to the recording sheet. The casing 58 accommodates the image forming unit 51, the intermediate transfer body 52, the transfer section 53 and the cleaning sections 65 and 54 therein.

Now referring to FIG. 3, an image forming operation performed by the image forming apparatus 50 in which the developer collecting apparatus 1 is installed will be briefly described. The image forming apparatus 50 illustrated in FIG. 3 is a full-color image forming apparatus, and provided with units for respective color components of black (k), yellow (y), magenta (m) and cyan (c) as the image forming unit 51. In the description of the operation, respective portions of the image forming unit 51 will be generically denoted by only reference numerals. In FIG. 3, however, the units for the respective color components will be denoted by the reference numerals with alphabets corresponding to the respective color components added to the ends.

First, the circumferential surfaces of the photoreceptors 61 are uniformly charged to predetermined potential by chargers 62. By applying a laser beam corresponding to image data from an exposing unit 70 to each of the charged photoreceptors 61, electrostatic latent images of the respective color components are formed on the respective photoreceptors 61. Next, toner of developer is supplied to the circumferential surfaces of the photoreceptors 61 from the developing sections 64, and the electrostatic latent images formed on the circumferential surfaces of the photoreceptors 61 are visualized with the toner, whereby toner images are formed.

The toner images of the respective color components formed on the photoreceptors 61 are successively stacked and transferred onto a transfer belt 81 of the intermediate transfer body 52 by intermediate transfer rollers 85, whereby toner images of full ranges of colors are obtained. When the transfer belt 81 moves and reaches the transfer section 53, transfer bias is applied by a transfer roller 91 to a recording sheet supplied from a bypass tray 111 or paper feeding cassette 112 through a registration roller 92 of a paper feeding section 55, whereby the toner images of full range of colors transferred onto the transfer belt 81 are transferred together onto the recording sheet.

The recording sheet with the toner images transferred is conveyed to a fixing section 56, and the toner images are thermally fixed onto the recording sheet in the fixing section 56. In the case of a single-side printing request, the recording sheet with the toner images fixed is ejected face down onto a paper ejecting section 57 by a paper ejecting roller 108.

In the case of a double-side printing request, after the recording sheet is held by the paper ejecting roller 108, the paper ejecting roller 108 is reversely rotated to guide the recording sheet to a double-side document conveying path S1, and the recording sheet is again conveyed to a registration roller 92 by first and second conveying rollers 109 and 110. At this moment, a transfer face of the recording sheet is reversed, and also a conveyance direction thereof is reversed. That is to say, an end portion of the recording sheet on a starting side at the time of first transfer is on an ending side at the time of transfer of a rear face, whereas an end portion on the ending side at the time of the first transfer is on the starting side at the time of transfer of the rear face. After a toner image is transferred and thermally fixed to the rear face of the recording sheet, the recording sheet is ejected onto the paper ejecting section 57 by the paper ejecting roller 108. Thus, a series of image forming operation to a recording sheet is performed.

The developer collecting apparatus 1 is installed in the image forming apparatus 50, and collects waste developer produced when residual developer produced on the photoreceptor 61 and the intermediate transfer body 52 in the aforementioned image forming operation performed by the image forming apparatus 50 is eliminated by the cleaning sections 65 and 54.

The developer collecting apparatus 1 comprises a positioning frame 4, a waste developer container 2 and a container mounting section 3. The positioning frame 4 determines a mounting position of the photoreceptor 61 onto a casing 58. In the waste developer container 2, the waste developer eliminated by the cleaning sections 54 and 65 is stored. The container mounting section 3 mounts the waste developer container 2 so as to be removable and holds an angular displacement position variable with respect to the positioning frame 4.

First, the positioning frame 4 of the developer collecting apparatus 1 will be described. The positioning frame 4 seems like a box that extends along the image forming unit 51 and intermediate transfer body 52 of the image forming apparatus 50, and is made of a hard synthetic resin or the like. On a sheet of FIG. 3 illustrating the image forming apparatus 50, at the back side (referred to as the operation side hereafter) of the image forming apparatus 50, the positioning frame is mounted on the casing 58.

Figure 4:
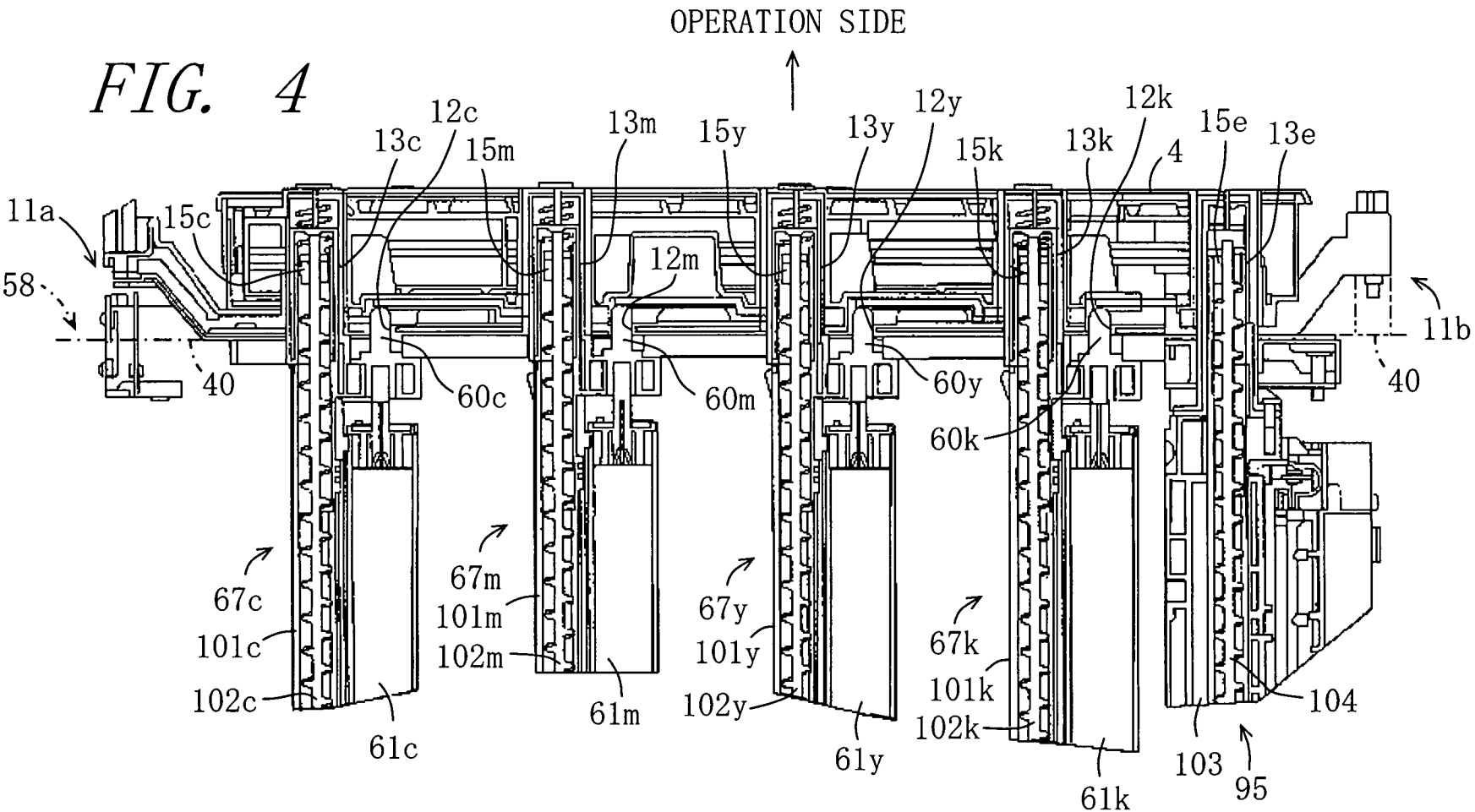
FIG. 4 is a cross section view in a longitudinal direction illustrating a state where a photoreceptor is positioned by the positioning frame.

FIG. 4 is a cross section view in a longitudinal direction illustrating a state where the photoreceptors 61 are positioned by the positioning frame 4. On both end portions in the longitudinal direction (referred to as the width direction hereafter) of the positioning frame 4 are disposed casing-position positioning members 11*a* and 11*b* for positioning on the casing 58.

The casing-position positioning members 11*a* and 11*b* have a supporting function to support the positioning frame 4 when the positioning frame 4 is mounted on the casing 58. The positioning frame 4 is positioned on the casing 58 so as to be positioned on an attachment face 40 of the casing 58 by the casing-position positioning members 11*a* and 11*b*. As a method for location of the casing-position positioning members 11*a* and 11*b* and the casing 58, a following method is used. A positioning component such as a positioning pin, a positioning block and a wedge-shaped fit is disposed to the positioning frame 4 so as to be capable of protruding. An engagement member engaging with the positioning component is disposed to the casing 58. The positioning component and the engagement member are engaged to position vertical and horizontal positions of the casing-position positioning members and the casing.

On the positioning frame 4, at portions corresponding to one end portions of photoreceptor axis bodies 60 of the photoreceptors 61 of the plurality of image forming units 51 comprised in the image forming apparatus 50, photoreceptor axis supporting holes 12*k*, 12*y*, 12*m* and 12*c* that engage with the one end portions of the photoreceptor axis bodies 60 are formed, respectively.

Further, photoreceptor cleaning apparatuses 65*k*, 65*y*, 65*m*, and 65*c* serving as the cleaning section on each of the image forming units 51 are respectively provided with photoreceptor waste toner conveying apparatuses 67*k*, 67*y*, 67*m*, and 67*c*. The positioning frame 4 has waste developer collecting ports 13*k*, 13*y*, 13*m*, and 13*c*, each of which is formed at a portion corresponding to one end portion of each of the photoreceptor waste toner conveying apparatuses 67*k*, 67*y*, 67*m*, and 67*c*. The waste developer collecting ports 13*k*, 13*y*, 13*m*, and 13*c* are positioned by respectively engaging with the one end portion of each of the photoreceptor waste toner conveying apparatuses 67*k*, 67*y*, 67*m*, 67*c*. The transfer body cleaning apparatus 54 serving as the cleaning section provided on the intermediate transfer body 52 is provided with a transfer body waste toner conveying apparatus 95. The positioning frame 4 has a waste developer collecting port 13*e* which is formed at a portion corresponding to one end portion of the transfer body waste toner conveying apparatus 95. The waste developer collecting port 13*e* is positioned by engaging with the one end portion of the transfer body waste toner conveying apparatus 95.

Below the waste developer collecting ports 13*k*, 13*y*, 13*m*, 13*c* and 13*e*, waste developer passages 14*k*, 14*y*, 14*m*, 14*c* and 14*e* that are passages toward the waste developer container 2 of waste developer conveyed by the photoreceptor waste toner conveying apparatuses 67*k*, 67*y*, 67*m* and 67*c* and the transfer body waste toner conveying apparatus 95 are formed, respectively. The waste developer collecting ports 13*k*, 13*y*, 13*m*, 13*c* and 13*e* and the waste developer passages 14*k*, 14*y*, 14*m*, 14*c* and 14*e* communicate via waste developer passing holes 15*k*, 15*y*, 15*m*, 15*c* and 15*e*, respectively.

That is to say, residual developer (waste developer) eliminated from the surfaces of the photoreceptors 61 and the surface of the intermediate transfer body 52 by the photoreceptor cleaning apparatuses 65*k*, 65*y*, 65*m* and 65*c* and the transfer body cleaning apparatus 54 is conveyed to the waste developer collecting ports 13*k*, 13*y*, 13*m*, 13*c* and 13*e* of the positioning frame 4 by the photoreceptor waste toner conveying apparatuses 67*k*, 67*y*, 67*m* and 67*c* and the transfer body waste toner conveying apparatus 95, passes through the waste developer passing holes 15*k*, 15*y*, 15*m*, 15*c* and 15*e*, and is collected into the waste developer container 2 through the waste developer passages 14*k*, 14*y*, 14*m*, 14*c* and 14*e*.

The positioning frame 4 is positioned by the casing-position positioning members 11*a* and 11*b*, and thereafter, mounted on the casing 58 with screws, bolts or the like at attachment portions 10 disposed around side edges at corners of the frame.

Figure 5:
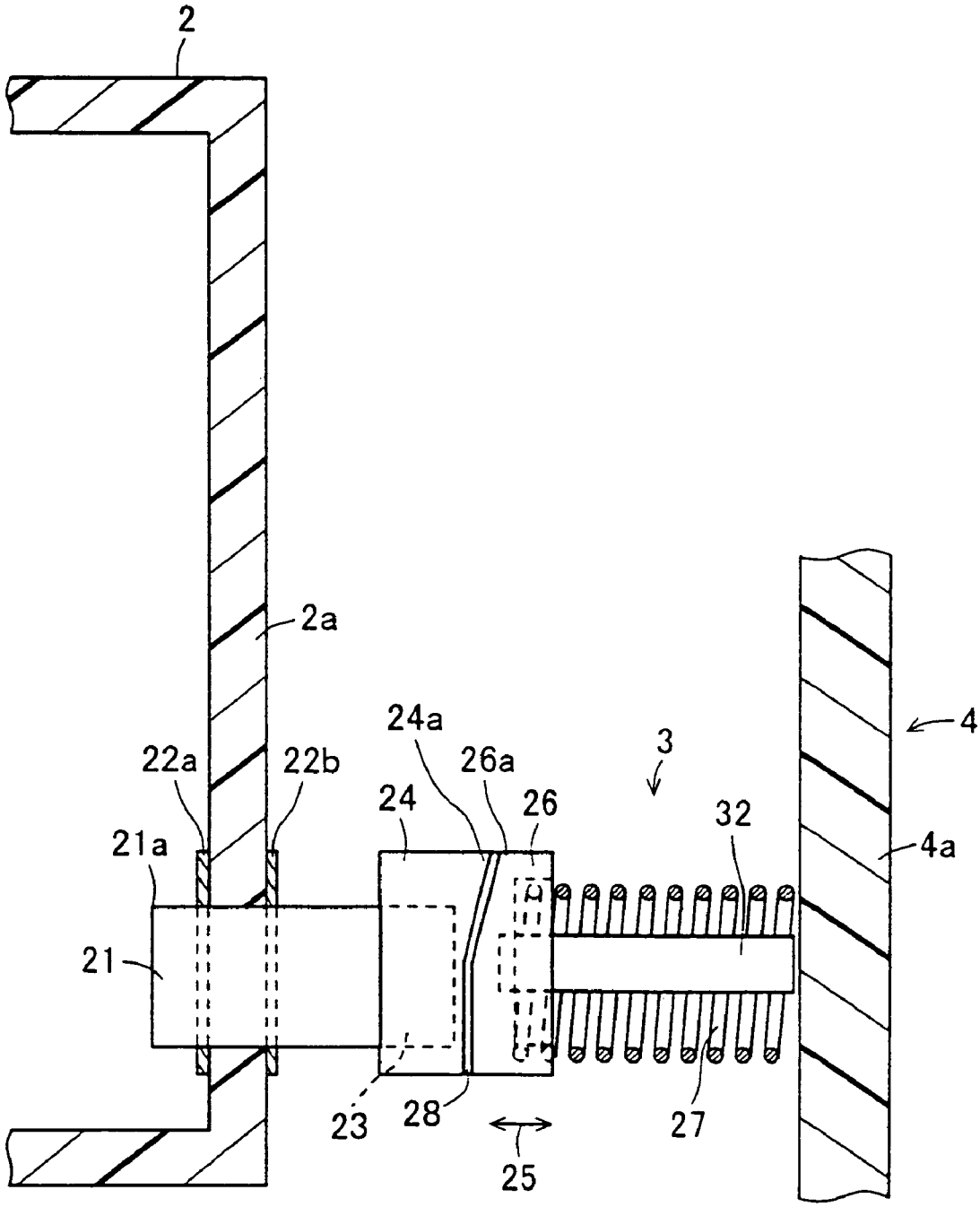
FIG. 5 is a side view illustrating the outline of a state where a waste developer container is mounted by container mounting section.
Figure 6:
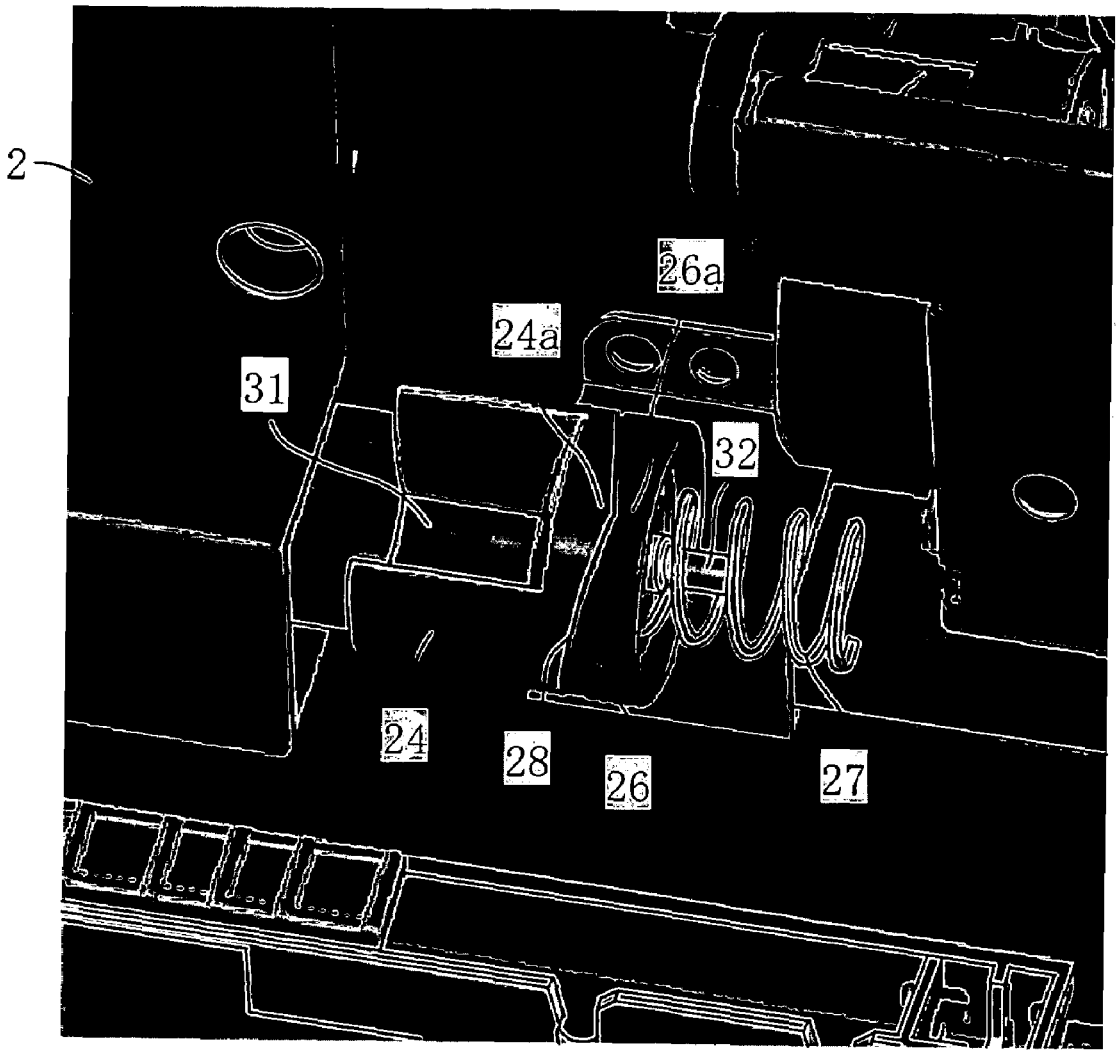
FIG. 6 is a simplified perspective view illustrating the configuration of the container mounting section.

The waste developer container 2 is mounted on a lower part of the positioning frame 4 by the container mounting section 3 so as to be removable and holds an angular displacement position variable with respect to the positioning frame 4. FIG. 5 is a side view illustrating the outline of a state where the waste developer container 2 is mounted by the container mounting section 3. FIG. 6 is a simplified perspective view illustrating the configuration of the container mounting section 3.

The waste developer container 2 is formed of, for instance, hard synthetic resin. A shape of the waste developer container 2 is a hollow rectangular parallelepiped extending in the horizontal width direction. In the waste developer container 2, waste developer collected through the waste developer passages 14*k*, 14*y*, 14*m*, 14*c* and 14*e* is stored.

On the waste developer container 2, at a lower part of a wall portion 2*a* formed in the horizontal direction, an arm member 21 is disposed so as to protrude toward a frame body 4*a* of the positioning frame 4. The arm member 21 is made of a hard synthetic resin or the like, formed into a substantially rectangular parallelepiped, and fixed at a portion around one end portion 21*a* to the wall portion 2*a* of the waste developer container 2 by fixing members 22*a* and 22*b*. The waste developer container 2 is held at a portion around the other end portion 21*b* (illustrated in FIG. 7 described later) of the arm member 21 by the container mounting section 3, and the portion around the other end portion 21*b* of the arm member 21 becomes an engagement projection 23.

In FIGS. 5 and 6, only a right side of the waste developer container 2 in the horizontal direction facing the apparatus main body is illustrated, but a left side is configured in a like manner so as to be symmetrical. Therefore, the configuration of the right side will be described as a representative, and a description of the left side will be omitted.

The container mounting section 3 includes a container holding member 24, a cam member 26, an elastic member 27, and a damper sheet 28. The container holding member 24 is disposed so as to freely make an angular displacement with respect to the positioning frame 4 and holds the waste developer container 2. The cam member 26 is disposed so as to be movable in a direction orthogonal to a direction in which the container holding member 24 is angularly displaced, that is, a direction parallel to a center axis which is an axis of rotation of the container holding member 24, that is to say, a direction to approach and leave the waste developer container 2 (a direction of an arrow 25). The elastic member 27 biases the cam member 26 to the container holding member 24 by an elastic force. The damper sheet 28 is attached onto a surface of the cam member 26 on a side facing the container holding member 24.

The container holding member 24 is made of, for instance, a metal or a hard synthetic resin, and is formed into a substantially columnar shape in appearance. The container holding member 24 has an engagement depression 31 that is a depression with a substantially rectangular parallelepiped extending in a center axis direction of the columnar shape and formed inward from a side face of the columnar shape. The engagement depression 31 is opened in one radial direction of the container holding member 24 so that the engagement projection 23 of the arm member 21 is detachable from outward in the radial direction of the container holding member 24. An end portion 24*a* of the container holding member 24 facing the frame body 4*a* of the positioning frame 4 is formed into a projecting V shape on a plan view of the substantially columnar container holding member 24 seen from the side face.

On the frame body 4*a* that is a frame member of the positioning frame 4, a supporting axis member 32 that is a rod-like member is formed so as to rise from the surface of the frame body 4*a* and extend straight toward the waste developer container 2. The container holding member 24 is mounted on the supporting axis member 32 so as to be angularly displaceable about the center axis but not to be slidably moved in the direction of the arrow 25, in a state where the end portion 24*a* formed into a projecting V shape (for the sake of convenience, referred to as the projecting V-shaped end portion 24*a* hereafter) faces the frame body 4*a*.

Figure 7:
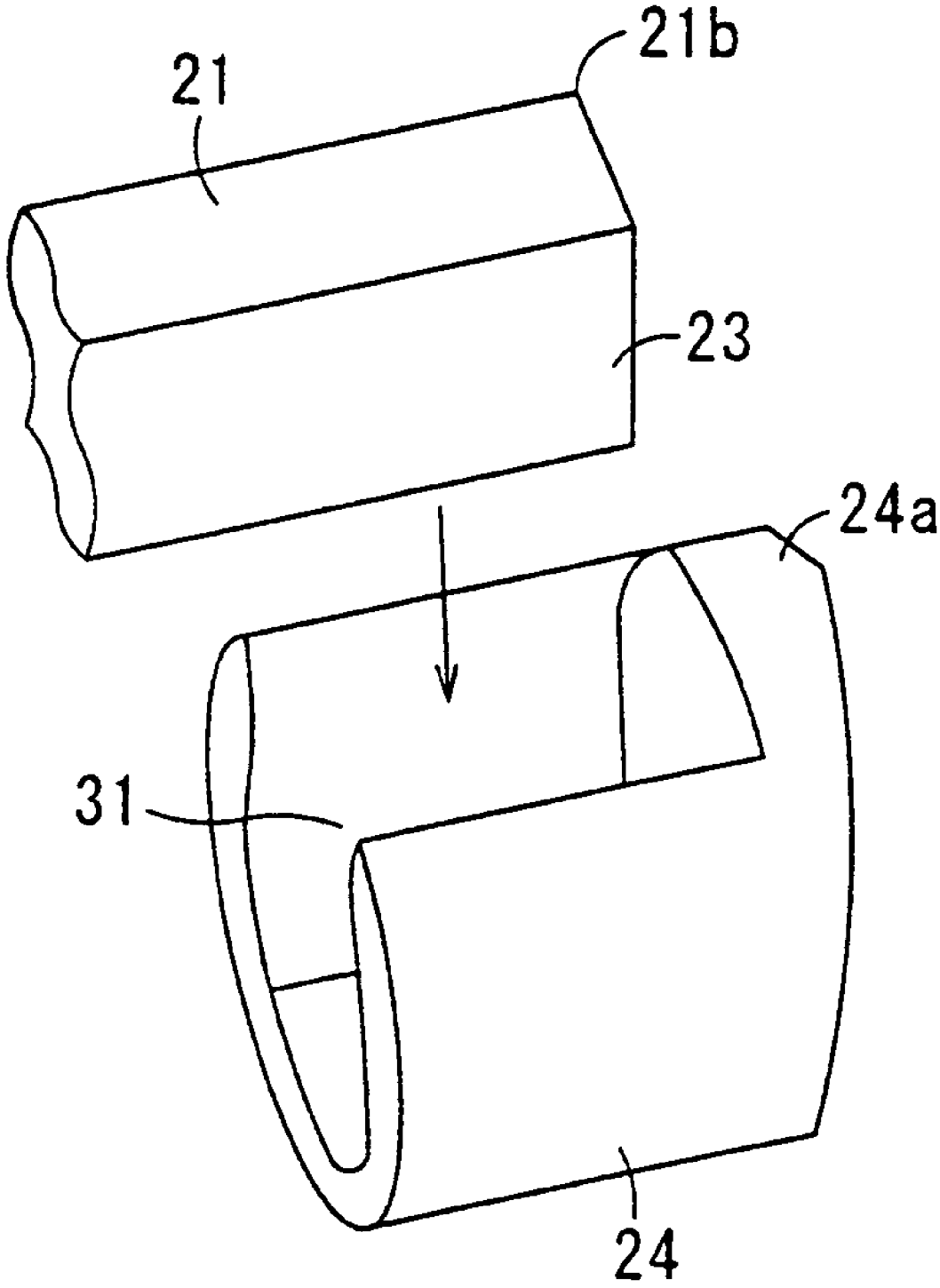
FIG. 7 is a view describing the outline of engagement of an engagement depression of a container holding member with an engagement projection of the waste developer container.

FIG. 7 is a view describing the outline of engagement of the engagement depression 31 of the container holding member 24 with the engagement projection 23 of the waste developer container 2. The waste developer container 2 is held so as to be removable from the container holding member 24 by engagement of the engagement projection 23 that is a portion around a free end portion of the supporting arm member 21 with the engagement depression 31 of the container holding member 24. The supporting arm member 21 is formed so that the shape of the engagement projection 23 having the rectangular parallelepiped fits the shape of the engagement depression 31 of the container holding member 24 and can engage with a little space left. Therefore, when the container holding member 24 is angularly displaced around the center axis, the supporting arm member 21 held on the container holding member 24 and the waste developer container 2 to which the supporting arm member 21 is firmly attached also is angularly displaced.

Referring to FIGS. 5 and 6 again, the cam member 26 is made of a metal, a hard synthetic resin or the like, and formed into a substantially columnar shape in appearance. An end portion 26*a* thereof facing the waste developer container 2 is formed into a depressing V shape on a plan view of the substantially columnar cam member 26 seen from the side face. The supporting axis member 32 is inserted into the cam member 26 along a center axis of the columnar shape. Further, the cam member 26 is mounted on the supporting axis member 32 inserted into a center portion thereof so as not to be angularly displaceable about the center axis but slidably moved in the direction of the arrow 25.

The cam member 26 and the container holding member 24 are placed so that the end portion 26*a* formed into a depressing V shape (for the sake of convenience, referred to as the depressing V-shaped end portion 26*a* hereafter) of the cam member 26 abuts on the projecting V-shaped end portion 24*a* of the container holding member 24. In the container mounting section 3 of the present embodiment, the damper sheet 28 is stuck to a face of the cam member 26 abutting on the container holding member 24. That is to say, the cam member 26 and the container holding member 24 abut on each other via the damper sheet 28.

A material of the damper sheet 28 is not limited in specific, but such a material that at least a face abutting on the container holding member 24 has a large coefficient of friction, for example, Clarino 0279L45-7000 (trade name; produced by Kuraray Co., Ltd.) is favorably used. The damper sheet 28 is disposed in order to prevent the container holding member 24 from being dislocated by the action of friction force in a position to which the container holding member has been angularly displaced.

As the elastic member 27, a coil spring member is used in the present embodiment. The elastic member 27 is placed between the frame body 4*a* of the positioning frame 4 and the cam member 26, and biases, namely, resiliently presses the cam member 26 with an elastic force to the container holding member 24 and the waste developer container 2 held by the container holding member 24.

An operation of the container mounting section 3 will be briefly described below. The container holding member 24 is angularly displaced by sliding on the cam member 26. A position to which the cam member 26 moves in a direction to approach and leave the waste developer container 2 illustrated with the arrow 25 varies depending on an angular displacement position of the container holding member 24 with respect to the positioning frame 4. Moreover, a biasing force of the elastic member 27 that biases the cam member 26 to the container holding member 24 varies depending on a position to which the cam member 26 moves in the direction of the arrow 25.

The container holding member 24 is disposed so as to be angularly displaceable about the center axis of the substantially columnar shape thereof but not to be slidably moved in the direction of the arrow 25. The cam member 26 is disposed so as not to be angularly displaceable about the center axis of the substantially columnar shape thereof but to be slidably moved in the direction of the arrow 25.

Accordingly, when the container holding member 24 is angularly displaced, the projecting V-shaped end portion 24*a* thereof slides on the depressing V-shaped end portion 26*a* of the cam member 26. When a cutting edge of the projecting V-shaped end portion 24*a* is positioned at the deepest portion of the depressing V-shaped end portion 26*a*, the cam member 26 is biased to the container holding member 24 by a biasing force of the elastic member 27, and is biased to the container holding member 24 by the weakest biasing force, because the cam member is positioned in the closest position to the waste developer container 2 in the direction of the arrow 25. In the present embodiment, the deepest portion of the depressing V-shaped end portion of the cam member 26, assuming a vertical line is at degree, is set to a position displaced 22 degrees around an axis of the supporting axis member 32 in a direction leaving the casing 58.

In a case where an angular displacement position of the container holding member 24 varies and the most protruding cutting edge of the projecting V-shaped end portion 24*a* is positioned at a slope portion of the depressing V-shaped end portion 26*a*, as the cutting edge leaves the deepest portion of the depressing V-shaped end portion 26*a*, a position of the cam member 26 along the arrow 25 shifts in a direction leaving the waste developer container 2, that is, a direction approaching the frame body 4*a* of the positioning frame 4, and the elastic member 27 is further compressed and deformed by the cam member 26 and the frame body 4*a*, with the result that the biasing force gets large as a reaction force.

The developer collecting apparatus 1 of the present embodiment is configured so that the angular displacement positions of the container holding member 24 with respect to the positioning frame 4 when the developer collecting apparatus is installed in the image forming apparatus 50 are set to at least three moving and holding positions including first, second and third positions.

Figure 8:
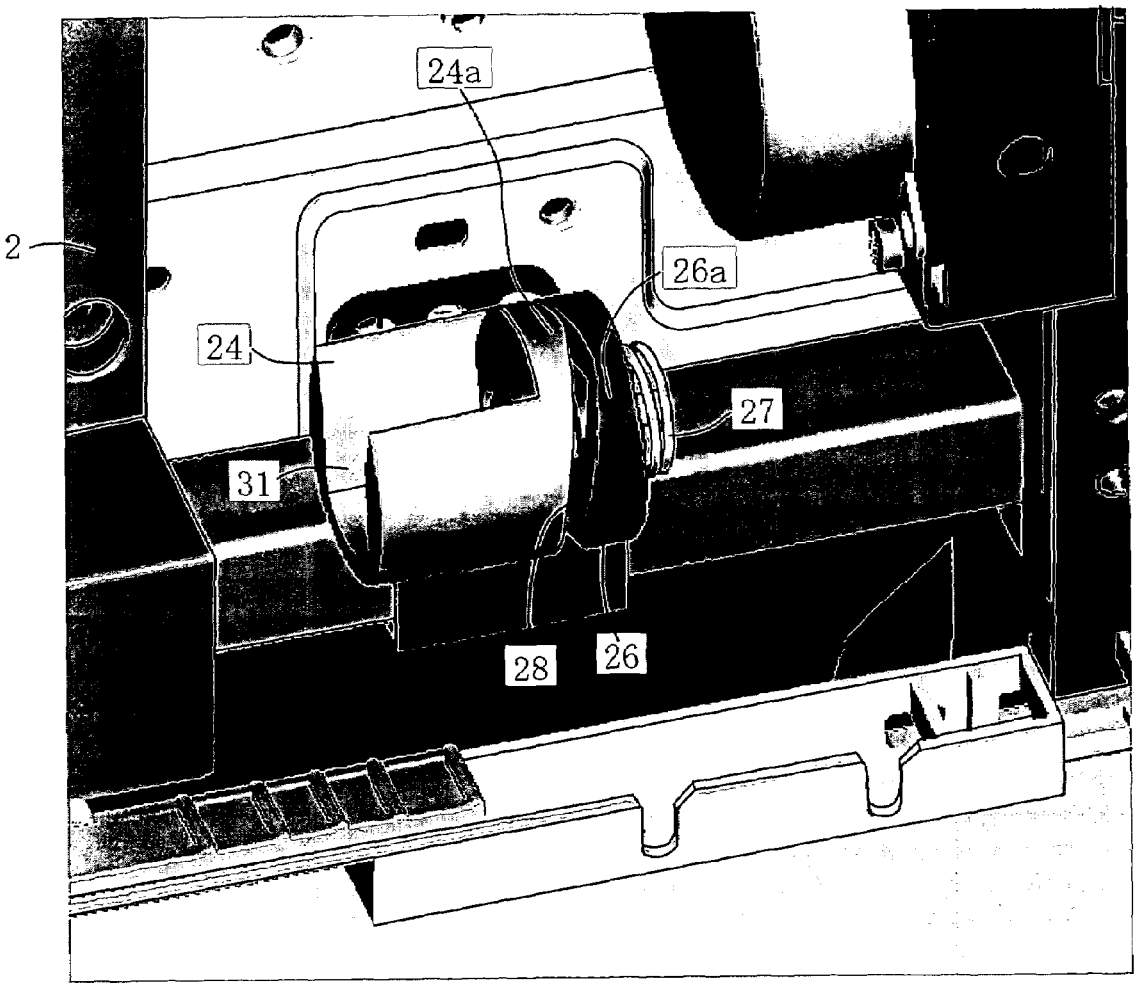
FIG. 8 is a view illustrating a positional relation between the container holding member in a first position and a cam member.
Figure 9:
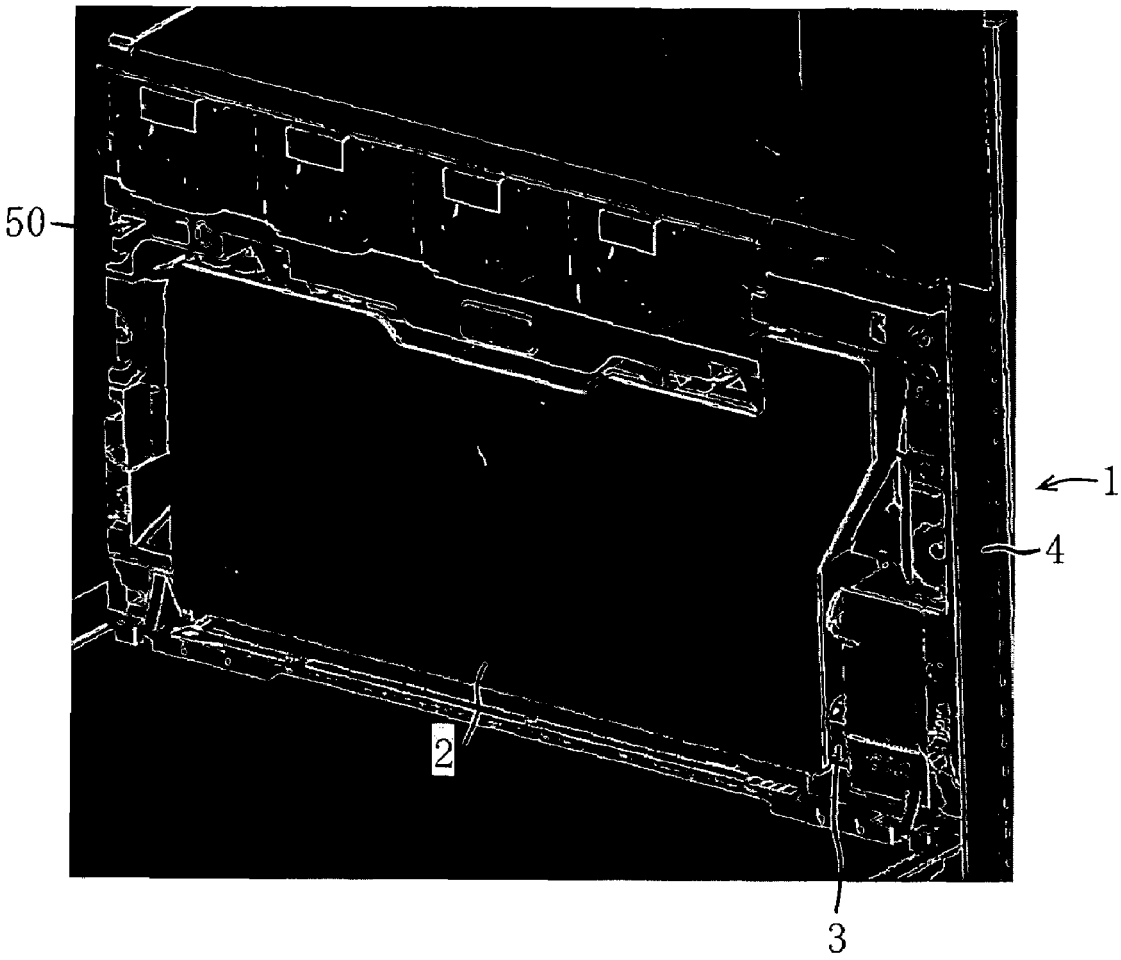
FIG. 9 is a view illustrating a state where the waste developer container is mounted on the positioning frame with the container holding member in the first position.

FIG. 8 is a view illustrating a positional relation between the container holding member 24 in the first position and the cam member 26. FIG. 9 is a view illustrating a state where the waste developer container 2 is mounted on the positioning frame 4 with the container holding member 24 in the first position.

The first position of the container holding member 24 is a position in which the cutting edge of the projecting V-shaped end portion 24*a* of the container holding member 24 is on the vertical line, that is, a position at 0 degree. In the first position, a position of the cutting edge of the projecting V-shaped end portion 24*a* of the container holding member 24 with respect to the cam member 26 is not at the deepest portion of the depressing V-shaped end portion 26*a* of the cam member 26 but on the slope portion. Therefore, a biasing force of the elastic member 27 biasing the cam member 26 to the container holding member 24 is larger than that in the position at 22 degrees described above.

At this moment, the waste developer container 2 is held upright, that is, at 0 degree while the arm member 21 firmly attached to the wall portion 2*a* of the waste developer container 2 engages at the engagement projection 23 around the free end position thereof with the engagement depression 31 of the container holding member 24. As illustrated in FIG. 9, the waste developer container 2 kept at 0 degree is held so as to close an opening portion of the image forming apparatus 50 in which the waste developer container is installed. In this first position, the container holding member 24 receives a strong biasing force of the elastic member 27 via the cam member 26, and strongly biases the arm member 21 of the waste developer container 2 with the elastic force, so that the waste developer container 2 is securely and stably held. In this first position, the developer collecting apparatus 1 collects waste developer produced in the image forming operation of the image forming apparatus 50 and eliminated by the cleaning apparatuses 54 and 65, into the waste developer container 2.

Figure 10:
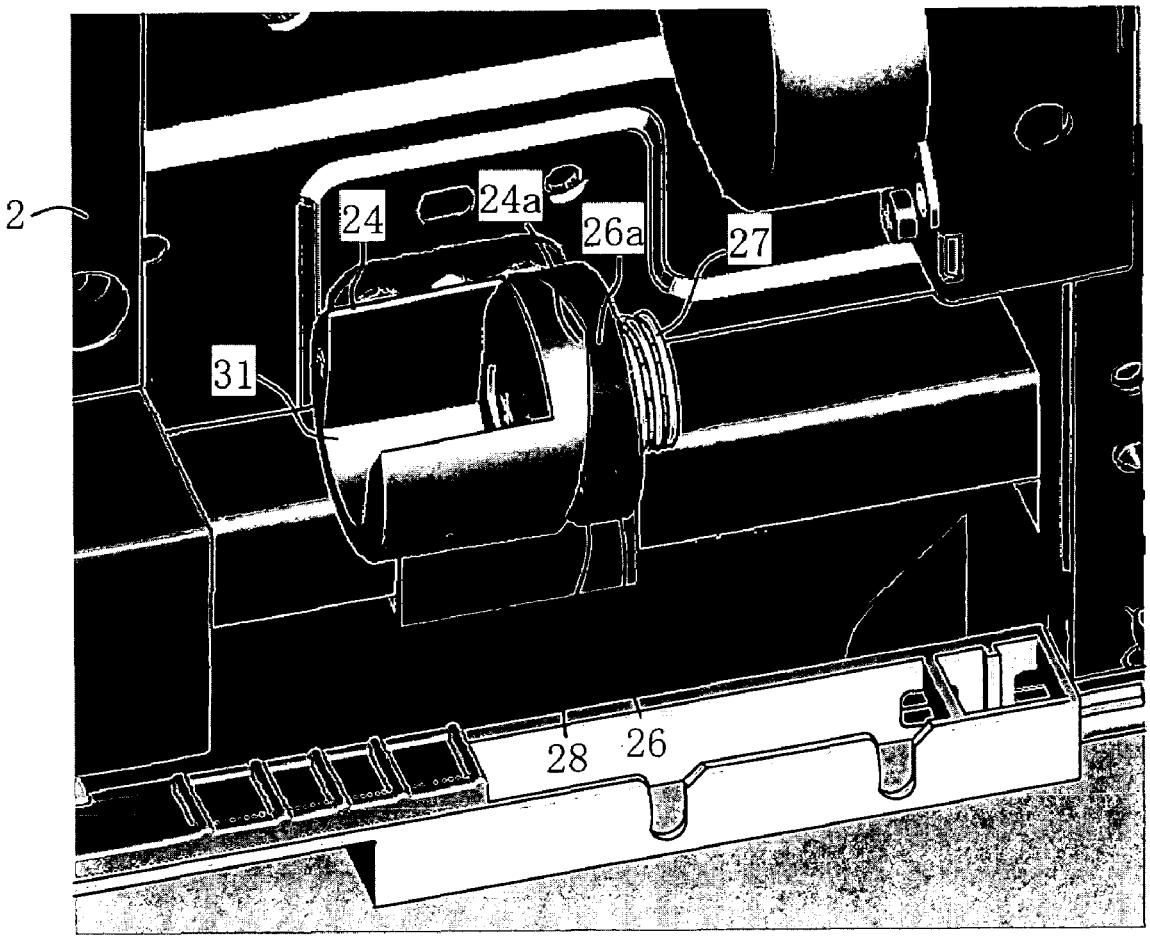
FIG. 10 is a view illustrating a positional relation between the container holding member in a second position and the cam member.
Figure 11:
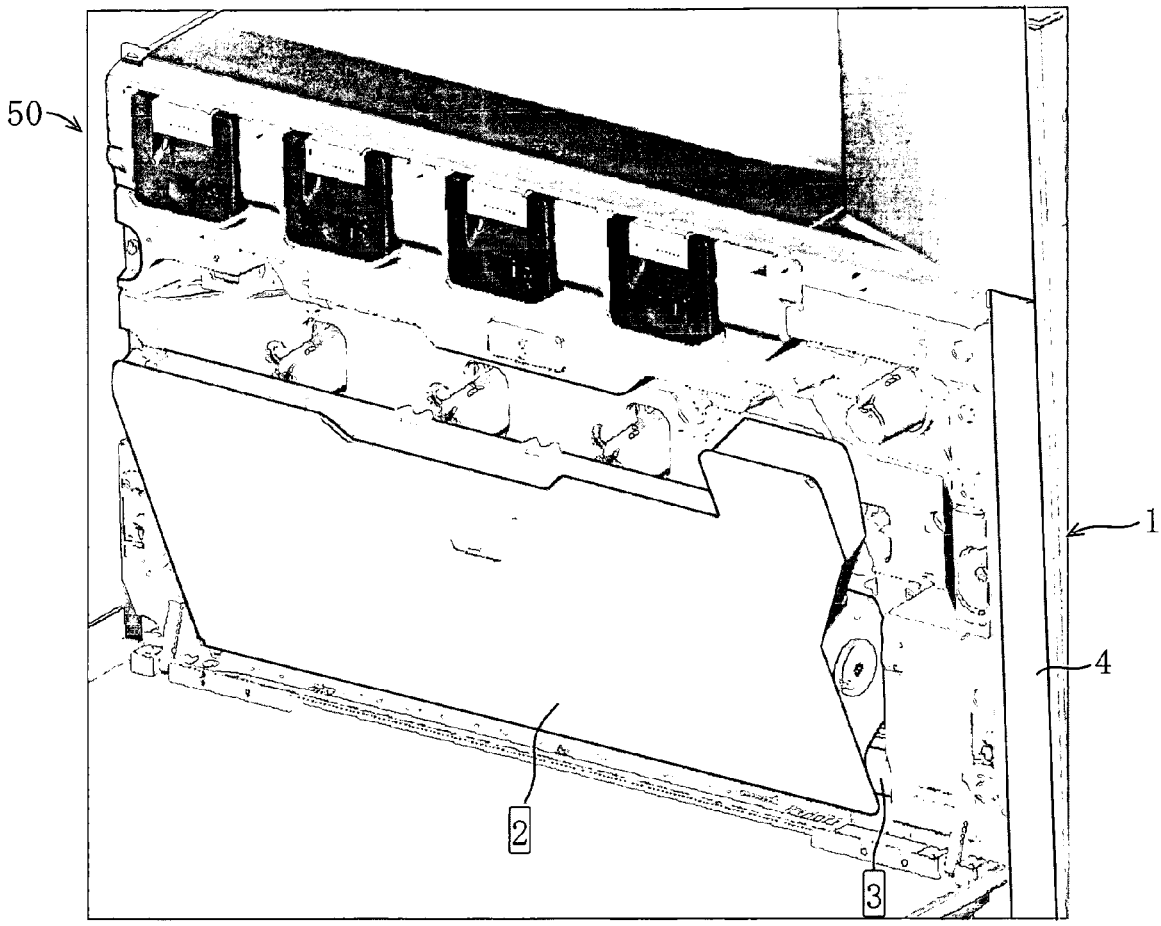
FIG. 11 is a view illustrating a state where the waste developer container is mounted on the positioning frame with the container holding member in the second position.

FIG. 10 is a view illustrating a positional relation between the container holding member 24 in the second position and the cam member 26. FIG. 11 is a view illustrating a state where the waste developer container 2 is mounted on the positioning frame 4 with the container holding member 24 in the second position. The second position of the container holding member 24 is a position in which the cutting edge of the projecting V-shaped end portion 24*a* of the container holding member 24 is at the deepest portion of the depressing V-shaped end portion 26*a* of the cam member 26, that is, the position at 22 degrees described above. Therefore, a biasing force of the elastic member 27 biasing the cam member 26 to the container holding member 24 is the smallest in the three positions of the container holding member 24.

At this moment, the waste developer container 2 is held inclined by 22 degrees while the arm member 21 firmly attached to the wall portion 2*a* of the waste developer container 2 engages at the engagement projection 23 around the free end portion thereof with the engagement depression 31 of the container holding member 24. As illustrated in FIG. 11, the waste developer container 2 inclined by 22 degrees is held so that it is possible to look in at the opening portion of the image forming apparatus 50 in which the waste developer container is installed. In this second position, the container holding member 24 merely receives the weakest elastic force of the elastic member 27 via the cam member 26, so that a biasing force biasing the arm member 21 of the waste developer container 2 is small, and it is easy to remove the waste developer container 2 from the container holding member 24. Accordingly, in this second position, replacement of the waste developer container 2 is carried out.

Figure 12:
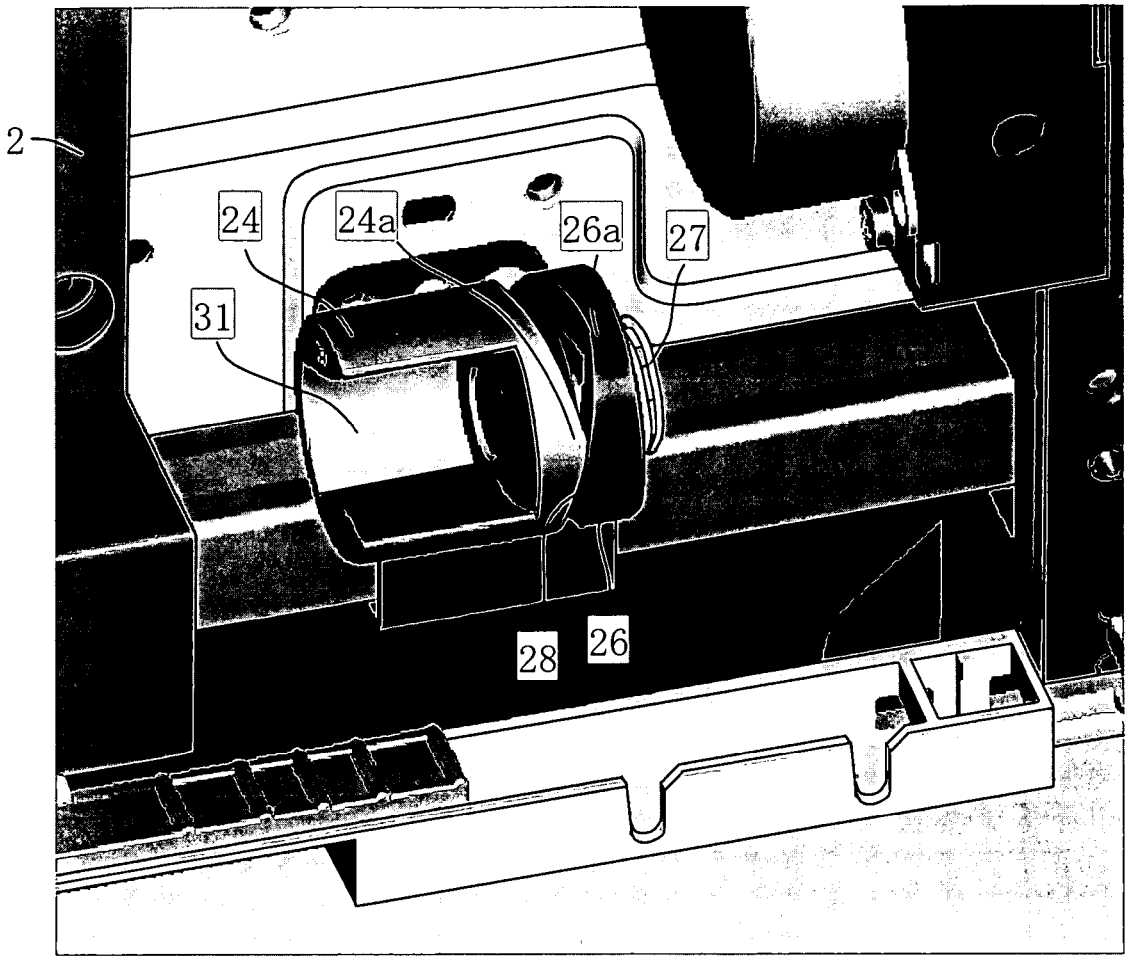
FIG. 12 is a view illustrating a positional relation between the container holding member in a third position and the cam member.
Figure 13:
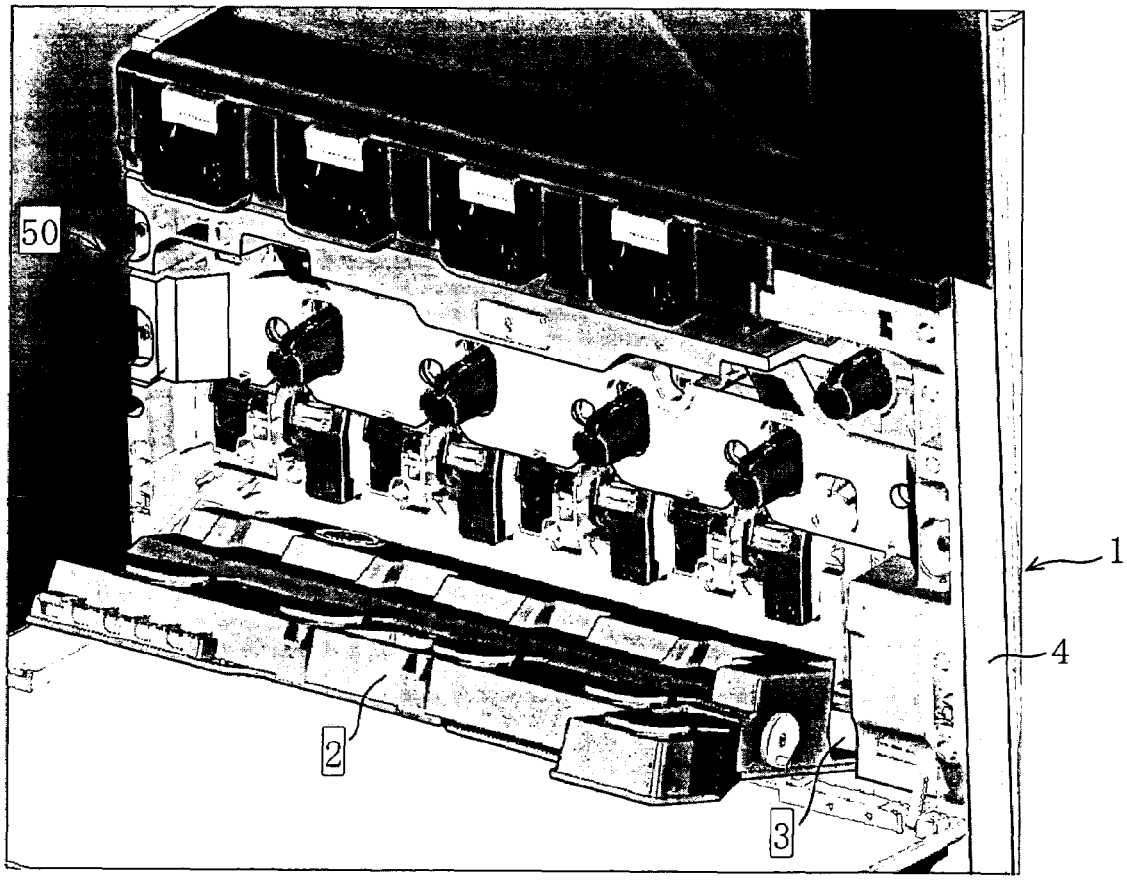
FIG. 13 is a view illustrating a state where the waste developer container is mounted on the positioning frame with the container holding member in the third position.

FIG. 12 is a view illustrating a positional relation between the container holding member 24 in the third position and the cam member 26. FIG. 13 is a view illustrating a state where the waste developer container 2 is mounted on the positioning frame 4 with the container holding member 24 in the third position. The third position of the container holding member 24 is a position in which the cutting edge of the projecting V-shaped end portion 24*a* of the container holding member 24 is on a slope portion of the depressing V-shaped end portion 26*a* of the cam member 26, the slope portion being a slope portion on the opposite side to the slope portion in the aforementioned first position with respect to the deepest portion. In the present embodiment, in the third position, the container holding member 24 is set in an angular displacement position of 73 degrees with respect to the vertical line. Therefore, a biasing force of the elastic member 27 biasing the cam member 26 to the container holding member 24 is larger than in the second position.

At this moment, as illustrated in FIG. 13, the waste developer container 2 is held by the container holding member 24 so as to widely open the opening portion of the image forming apparatus 50 in which the waste developer container is installed. In this third position, the container holding member 24 receives a strong biasing force of the elastic member 27 via the cam member 26, and strongly biases the arm member 21 of the waste developer container 2 with the elastic force, so that the waste developer container 2 is securely and stably held. In this third position, the waste developer container 2 is kept in a state where the opening portion of the image forming apparatus is widely opened, and the operator can easily carry out maintenance of the image forming apparatus 50.

As described above, the developer collecting apparatus 1 of the present embodiment has such a configuration that three positions are determined as an angular displacement position of the container holding member 24, that is, a relative position of the waste developer container 2 to the image forming apparatus 50, but the configuration is not limited to the above one, and may be such a configuration that more than three positions are set in advance.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developer collecting apparatus installed in an image forming apparatus having an image carrier on which an electrostatic latent image is formed by exposure with light corresponding to image data; an intermediate transfer body to which a developer image obtained by developing the electrostatic latent image on the image carrier is transferred; a cleaning section for eliminating residual developer that remains on the image carrier without being transferred from the image carrier to the intermediate transfer body and residual developer that remains on the intermediate transfer body without being transferred from the intermediate transfer body to a transfer-subjected medium; and a casing for accommodating the image carrier, the intermediate transfer body and the cleaning section therein, the developer collecting apparatus collecting the developer eliminated from the image carrier and the intermediate transfer body by the cleaning section, the developer collecting apparatus comprising:

a positioning frame for determining a mounting position of the image carrier onto the casing;

a waste developer container in which waste developer eliminated by the cleaning section is stored; and a container mounting section for mounting the waste developer container so as to be removable from the positioning frame and holding the waste developer container so as to be angularly displaceable with respect to the positioning frame, wherein the container mounting section includes a biasing device for biasing the waste developer container into a predetermined angular position with respect to the positioning frame.

2. The developer collecting apparatus of claim 1, wherein the container mounting section includes a container holding member disposed so as to be angularly displaceable with respect to the positioning frame, for holding the waste developer container and wherein the biasing device comprises:

a cam member disposed so as to be movable in a direction orthogonal to a direction in which the container holding member is angularly displaced; and an elastic member for biasing the cam member to the container holding member with an elastic force.

3. The developer collecting apparatus of claim 2, wherein an engagement projection is formed on the waste developer container; an engagement depression is formed on the container holding member of the container mounting section; and the waste developer container is held by the container holding member so as to be removable, by engagement of the engagement projection with the engagement depression of the container holding member.

4. The developer collecting apparatus of claim 2, wherein the elastic member is placed between the positioning frame and the cam member, and biases the cam member to the container holding member with an elastic force.

5. The developer collecting apparatus of claim 2, wherein the container holding member is angularly displaced by sliding on the cam member; a position to which the cam member moves varies depending on an angular displacement position of the container holding member with respect to the positioning frame; and a biasing force of the elastic member that biases the cam member to the container holding member varies depending on the position to which the cam member moves.

6. The developer collecting apparatus of claim 5, wherein first, second and third positions are determined as angular displacement position of the container holding member with respect to the positioning frame; wherein a biasing force of the elastic member when the container holding member is in the second position is smaller than a biasing force of the elastic member when the container holding member is in the first and third positions; wherein the waste developer container is held so as to close an opening portion of the image forming apparatus in which the waste developer container is to be provided, when the container holding member is in the first position; wherein the waste developer container can be removed from the container holding member when the container holding member is in the second position; and wherein the waste developer container is held so as to open the opening portion of the image forming apparatus in which the waste developer container is to be provided when the container holding member is in the third position.

7. The developer collecting apparatus of claim 1, wherein the biasing device biases the waste developer into a position where it can be dismounted from or mounted on the positioning frame.

8. A developer collecting apparatus installed in an image forming apparatus having an image carrier on which an electrostatic latent image is formed by exposure with light corresponding to image data and an intermediate transfer body to which a developer image obtained by developing the electrostatic latent image on the image carrier is transferred, a first cleaning section for collecting residual developer that remains on the image carrier without being transferred from the image carrier to the intermediate transfer body, and a second cleaning section that collects residual developer that remains on the intermediate transfer body without being transferred from the intermediate transfer body to a transfer-subjected medium, the developer collecting apparatus comprising:

a positioning frame mounted on a casing of the image forming apparatus;

a waste developer container in which waste developer collected from both the image carrier and the intermediate transfer body is stored, wherein an engagement projection extends from at least one side of the waste developer container; and a container mounting section for removably mounting the waste developer container on the positioning frame and for holding the waste developer container so that it is angularly displaceable with respect to the positioning frame, wherein the container mounting section comprises:

a container holding member that is mounted on the positioning frame so as to be angularly displaceable with respect to the positioning frame, wherein the container holding member receives and holds the engagement projection of the waste developer container; and a biasing device that biases the waste developer container into a predetermined angular position with respect to the positioning frame.

9. The developer collecting apparatus of claim 8, wherein the biasing device biases the waste developer container into a position where it can be removed from and attached to the positioning frame.

10. The developer collecting apparatus of claim 8, wherein the container holding member receives the engagement projection such that the container holding member does not rotate with respect to the engagement projection.

11. The developer collecting apparatus of claim 10, wherein the container holding member comprises a first cam surface, and wherein the biasing device comprises:

a cam member with a second cam surface that engages the first cam surface of the container holding member; and an elastic member that biases the second cam surface of the cam member toward the first cam surface of the container holding member.

12. The developer collecting apparatus of claim 11, wherein the cam member is not angularly displaceable with respect to the positioning frame, and wherein the shapes of the first and second cam surfaces and the biasing force of the elastic member act to bias the waste developer container into the predetermined angular position with respect to the positioning frame.

13. The developer collecting container of claim 12, wherein the elastic member is positioned between the positioning frame and the cam member.

14. The developer collecting container of claim 11, further comprising a damper member positioned between the first cam surface and the second cam surface.

* * * * *